United States Patent [19]

Nakajima

[11] 4,318,804

[45] Mar. 9, 1982

[54] DEVICE FOR SEPARATING MIXTURE

[75] Inventor: Takato Nakajima, Sakakimachi, Japan

[73] Assignee: Kanetsu Kogyo Kabushiki Kaisha, Ueda, Japan

[21] Appl. No.: 204,809

[22] Filed: Nov. 7, 1980

[30] Foreign Application Priority Data

Nov. 16, 1979 [JP] Japan ..... 54-147618
Dec. 12, 1979 [JP] Japan ..... 54-160343

[51] Int. Cl.[3] ..... B03C 1/12
[52] U.S. Cl. ..... 209/221; 209/230
[58] Field of Search ..... 209/212, 214, 221, 224, 209/228, 216, 230

[56] References Cited

U.S. PATENT DOCUMENTS 3,045,822 7/1962 Cavanagh ..... 209/231 X
4,046,679 9/1977 Schloemann ..... 209/212
4,230,560 10/1980 Nakajima ..... 209/212

*Primary Examiner*—Ralph J. Hill
*Attorney, Agent, or Firm*—Stephen F. K. Yee

[57] ABSTRACT

A device for separating a mixture material into a magnetic material, a nonmagnetic conductive material and a nonmagnetic nonconductive material. The device comprises a drum revolving in one direction about a longitudinal central axis thereof. The magnetic material of the mixture material thrown into the drum is attracted to the inner peripheral surface of the drum by the magnetism of a magnetic field surrounding the drum and rotating in a reverse direction to a direction of rotation of the drum, and released from the inner peripheral surface of the drum in a predetermined rotational region in the drum, thereby being received on a receiving member. The nonmagnetic nonconductive material is directed in the direction of rotation of the drum along the inner peripheral surface of the drum, and the nonmagnetic conductive material is directed in a reverse direction to the direction of rotation of the drum by the electromagnetic force of the rotating magnetic field.

8 Claims, 12 Drawing Figures

DEVICE FOR SEPARATING MIXTURE

BACKGROUND OF THE INVENTION

1. Field of the Invention

This invention relates to a device for separating a mixture generally collected as waste into a magnetic material as represented by iron pieces, a nonmagnetic conductive material as represented by aluminum cans, and a nonmagnetic nonconductive material as represented by waste paper and/or wood pieces.

2. Description of the Prior Art

A mixture material collected as waste is largely classified into the magnetic material, the nonmagnetic conductive material and the nonmagnetic nonconductive material. With a view to separating the magnetic material from the mixture, a variety of magnetic separating devices utilizing attraction of magnet have hitherto been proposed. Furthermore, for the purpose of separating the nonmagnetic conductive material and the nonmagnetic nonconductive material from the mixture, from which the magnetic material has been removed beforehand by such a magnetic separation device, a device for separating a nonmagnetic conductive material has been proposed by the U.S. Application Ser. No. 59,648 by the same inventor, now U.S. Pat. No. 4,230,560.

The aforesaid nonmagnetic-conductive-material separating device includes; a drum revolving in one direction about the longitudinal axis thereof serving as the axis of rotation; and a means for generating a magnetic field surrounding the drum and rotating about the aforesaid axis of rotation coaxially with the drum but in a reverse direction to the direction of rotation of the drum. The mixture remaining after the removal of magnetic material therefrom is thrown into the drum, and the nonmagnetic nonconductive material contained in the mixture is directed in the direction of rotation of the drum by rotation of the drum. On the other hand, the nonmagnetic conductive material is directed in a reverse direction to the direction of rotation of the drum by action of an electromagnetic force of the rotating magnetic field and an eddy current generated internally of the drum by the rotating magnetic field.

In the aforesaid separating device, the high speed rotation of the rotary magnetic field rotating in the reverse direction to the direction of rotation of the drum independently of the drum causes the strong electromagnetic force to act on the nonmagnetic conductive material, without causing the strong centrifugal force to act on the mixture existing in the drum, thereby effectively separating the nonmagnetic nonconductive material from the nonmagnetic conductive material.

The aforesaid separating device, however, failed to separate the magnetic material from the mixture. In the event that the mixture contains only a small amount of magnetic material, such a magnetic material remaining in the mixture would undesirably be attracted to the inner peripheral wall of the drum by the magnetic force of the rotating magnetic field and rotated integrally with the drum, thus impairing separation of the nonmagnetic conductive material from the nonmagnetic nonconductive material.

SUMMARY OF THE INVENTION

It is accordingly an object of the present invention to provide a device for separating a magnetic material, a nonmagnetic conductive material and a nonmagnetic nonconductive material from a mixture.

To attain the object, there is provided according to the present invention a device for separating a mixture which comprises; a drum set in a non-perpendicular posture and made of a nonmagnetic substance, the drum being adapted to be supplied with a mixture being treated, and rotated in one direction about the longitudinal axis thereof; an annular magnetic device surrounding the drum at a spacing from the outer peripheral surface thereof, and generating a magnetic field rotating in a reverse direction to a direction of rotation of the drum, so as to attract the magnetic material in the mixture to the inner peripheral surface of the drum and cause an electromagnetic force reverse to the direction of rotation of the drum to act on the nonmagnetic conductive material of the mixture; a means for releasing the magnetic material from the inner peripheral surface of the drum in a predetermined rotational zone of the drum; and a means for receiving the magnetic material released from the inner peripheral surface of the drum.

According to one embodiment of the present invention, the annular magnetic device serving as the releasing means is arranged eccentrically with respect to the drum in a manner that the central axis of the device is deflected upward from the central axis of the drum, so that the magnetic material magnetically attracted to the inner peripheral wall of the drum can be released therefrom in the vicinity of the top of the drum.

According to another embodiment of the present invention, the releasing means consists of a magnetic shield disposed between the upper portion of the drum and the annular magnetic device, so that the magnetic material magnetically attracted to the inner peripheral surface of the drum can be released therefrom in the vicinity of the top of the drum by the magnetism shielding effect of the magnetic shield.

DESCRIPTION OF THE PREFERRED EMBODIMENTS

Figure 1:
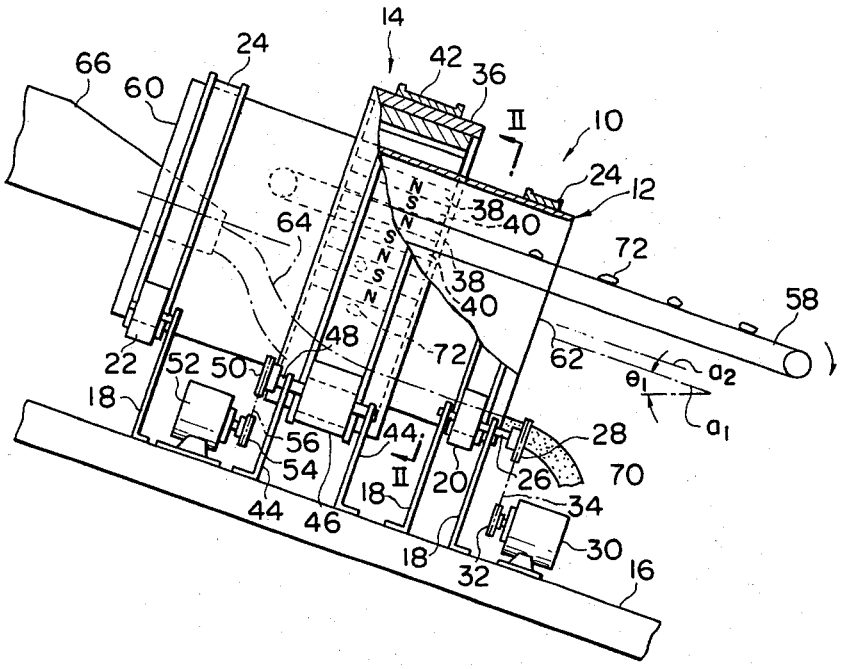
FIG. 1 is a front view, partly broken away, of a device for separating a mixture, according to a first embodiment of the invention.

A separating device 10 according to the present invention comprises; a drum 12 made of a nonmagnetic substance and open at the opposite ends; an annular magnetic means 14; and a frame 16, as seen in FIG. 1.

The frame 16 is tilted, to which a pair of drive rollers 20 and a pair of driven rollers 22 (only one drive roller and one driven roller are shown in FIG. 1) are attached through the medium of brackets 18, respectively. The drum 12 has on the opposite end portions annular guide members 24, in which are fitted the pair of drive rollers 20 and driven rollers 22, respectively. The drum 12 is thus supported rotatably on the longitudinal central axis $a_1$ in a manner to be inclined at an angle $\theta_1$ with respect to the horizontal plane. The angle $\theta_1$ is optional so long as the central axis $a_1$ does not become vertical.

Figure 2:
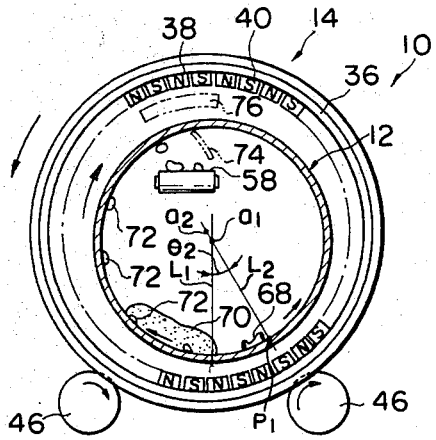
FIG. 2 is a transverse cross sectional view taken along the line II—II of FIG. 1.

A rotational force of a motor 30 is transmitted to the drive rollers 20 by way of a chain 34 trained about sprockets 28 mounted on shafts 26 of the drive rollers 20 and a sprocket 32 mounted on a rotary shaft of the motor 30, so that, by rotation of the drive rollers 20, the drum 12 will be rotated clockwise, as viewed in FIG. 2, about the central axis $a_1$ thereof.

The magnetic means 14 includes an annular member 36 having an inner diameter larger than the outer diameter of the drum 12 and positioned substantially in the mid portion of the drum. A plurality of permanent magnets 38 and 40 are embedded in the inner peripheral wall of the annular member 36. The plurality of magnets 38 and 40 are arranged in a side-by-side relation to each other in the circumferential direction of the drum at a spacing from the outer peripheral surface of the drum in a manner to surround same and in a manner that the north and south poles circumferentially alternate with each other, in the magnetic pole faces near to the outer peripheral surface of the drum, as clearly shown in FIG. 2. Magnetic pole boundaries between respective adjacent magnets 38 and 40 extend in parallel to the central axis $a_2$ of the annular member 36, as shown in FIG. 1.

An annular guide member 42 is provided on the outer peripheral surface of the annular member 36, so that the annular member 36 can be set, with the aid of the annular guide member 42, on a pair of drive rollers 46 which are carried by brackets 44 supported on the frame 16, respectively. The central axis $a_2$ of the annular member 36 extends in parallel to the central axis $a_1$ of the drum 12 in a position deflected upward from the central axis $a_1$. This arrangement advantageously defines a spacing between the drum 12 and the annular member 36 in the manner that a spacing in the lower portion of the drum is small enough to attract a below-described magnetic material to the inner peripheral surface of the drum 12 by the magnetically attracting force of the magnets 38 and 40 in the annular member 36, and a spacing in the upper portion of the drum, namely, in the vicinity of the top of the drum, is large enough to release the magnetic material from the inner peripheral surface of the drum 12.

In the cross section of the embodiment shown in FIG. 2, $P_1$ is the point at which the drum 12 comes nearest to the annular member 36, namely, to the magnetic means 14, $L_1$ is a perpendicular, diametric line passing through the central axis $a_1$ of the drum 12. The point $P_1$ lies on the side of the line $L_1$ which is deviated in the reverse direction to the direction of rotation of the drum 12. The perpendicular line $L_1$ passing the central axis $a_1$ of the drum 12 makes an angle $\theta_2$ with respect to the line $L_2$ passing the point $P_1$. It is possible to set the point $P_1$ on the perpendicular line $L_1$ or on the side deviated from the perpendicular line $L_1$ in the direction reverse to the direction of rotation of the drum 12. The angle $\theta_2$ is preferably in the range of 0° to 30° from the viewpoint of ensuring an increased separation efficiency of a nonmagnetic. nonconductive material from a nonmagnetic, conductive material, both of which will be described later.

A rotational force of a motor 52 is transmitted to the pair of drive rollers 46 carrying the annular member 36 by way of a chain 56 trained about sprockets 50 mounted on shafts of the drive rollers and a sprocket 54 mounted on a rotary shaft of the motor 52. Rotation of the drive rollers 46 runs the annular member 36 counterclockwise in FIG. 2 on the central axis $a_2$ serving as the axis of rotation, whereby a magnetic field rotating in a reverse direction to the direction of rotation of the drum 12 is produced internally of the drum 12.

A belt conveyor 58 is provided internally of the drum 12, so as to receive the magnetic material thereon and discharge same to the outside of the drum. The belt conveyor 58 extends from the inner part of the drum 12 through a lower opening 62 thereof to the outside of the drum, with one end located in a portion nearer to the upper opening 60 than to the central portion of the drum, and with the other end located externally of the drum, so that the transporting surface of the belt can move from the one end to the other.

A chute 66, through which a mixture 64 is continuously thrown into the drum 12, is inserted through the upper opening 60 into the drum 12 rotated in one direction alone. The mixture 64 thrown through the chute 66 into the drum 12 is directed by its own weight to the lower opening 62 of the drum 12. In this connection, the nonmagnetic, conductive material 68, such as aluminum cans, of the mixture 64 moves relatively across the magnetic flux of the rotating magnetic field when passing the rotating magnetic field zone, without receiving a magnetically attracting force of the rotating magnetic field in the annular member 36. Consequently, an eddy current is induced in the nonmagnetic conductive material 68. Owing to the electromagnetic action of the eddy current and the rotating magnetic field, the nonmagnetic conductive material 68 is directed along the bottom wall of the drum 12 as the material is kept deflected to the reverse direction to the direction of rotation of the drum, to the lower opening 62 of the drum 12, as seen in FIG. 2.

A nonmagnetic, nonconductive material 70, such as waste paper and/or wood pieces, of the mixture 64 also passes through the rotating magnetic field zone, but no eddy current is induced in the nonmagnetic nonconductive material 70. The nonmagnetic, nonconductive material 70 is therefore directed along the bottom wall of the drum 12 to the lower opening 62 of the drum, as the material is kept deflected to the opposite direction to the conductive material 68, namely, to the direction of rotation of the drum 12.

It should be noted that the conductive material 68 and the nonconductive material 70 of the mixture 64 pass through the rotating magnetic field, as described above, but a magnetic material 72 as represented by iron pieces by no means passes the rotating magnetic field zone along the bottom of the drum 12. The magnetic material 72 of the mixture 64 is rotated integrally with the drum 12 as the former is kept magnetically attracted to the inner peripheral surface of the drum in the rotating magnetic field zone, and released from the inner peripheral surface of the drum 12 in the predetermined rotational region in which the spacing between the drum 12 and the annular member 36 increases. The magnetic material 72 thus released is received by the belt conveyor 58, to be carried away to the outside of the drum 12.

From this it is understood that separation of the conductive material 68 from the nonconductive material 70 is by no means impaired by the magnetic material 72, but the mixture 64 is separated with high efficiency into the conductive material 68, the nonconductive material 70 and the magnetic material 72, while the conductive material 68 and the nonconductive material 70 are continuously discharged from the lower opening 62 of the drum 12 separately from each other, and while the magnetic material 72 is continuously discharged from the other end of the belt conveyor 58.

Because the nonmagnetic conductive material 68, in general, contains a large amount of waste of such a configuration as being apt to roll or tumble such as aluminum cans, and the material is larger in specific gravity than the nonmagnetic nonconductive material 70, the conductive material 68 gathers more densely on the side deviated in the reverse direction to the direction of rotation of the drum 12 from the perpendicular line $L_1$. In order to cause the electromagnetic force to effectively act on the conductive material 68 thus densely accummulated, it is preferable to set the aforesaid proximity point $P_1$ on the side deviated in the reverse direction to the direction of rotation of the drum 12 from the perpendicular line $L_1$, as described in the foregoing. In order to prevent the remixing of the conductive material 68 with the nonconductive material 70, which have been once separated from each other, it is recommended to dispose a separation plate (not shown) adjacent to the lower edge of the lower opening 62 of the drum 12.

The magnetic material 72 may be discharged from the upper opening 60 of the drum 12 by means of a belt conveyor of the same type as described above. In place of the belt conveyor, a trough may be used. Furthermore, the belt conveyor or the trough for receiving the magnetic material may be substituted by a tray free to get into and retract from the drum 12. From the viewpoint of continuously discharging the magnetic material separated, the belt conveyor or the trough having a transporting function as described above is preferable.

In the embodiment of FIGS. 1 and 2, the drum 12 and the annular member 36 are disposed with the rotational axes $a_1$ and $a_2$ inclined, but these drum and annular member may be disposed with their axes maintained horizontal. In the latter case, however, the continuous discharge of the conductive material 68 and the nonconductive material 70 from the lower opening 62 of the drum 12 is cannot be achieved, and hence an extra operation for removal of the conductive material 68 and the nonconductive material 70 accummulated in the drum is needed. If the magnetic pole boundary lines between respective adjacent magnet 38 and 40 are tilted with respect to the central axis $a_2$, then components of force parallel to the central axis $a_2$ could be provided to the electomagnetic force according to a direction of inclination, so that the conductive material 68 could be discharged from the upper opening 60 of the drum 12 or positively directed to the lower opening 62 of the drum, for being discharged therefrom.

As an auxiliary means for ensuring the release of the magnetic material 72 from the inner peripheral surface of the drum 12, a scraper 74 for scraping the magnetic material 72 off the inner peripheral surface of the drum 12 onto the belt 58 may be provided in the manner shown in FIG. 2. In place of the scraper, there may be provided between the drum 12 and the magnetic means 14 on the upper side of the drum a magnetic shield 76 which is to be used as a releasing means in another embodiment of the present invention.

Figure 3:
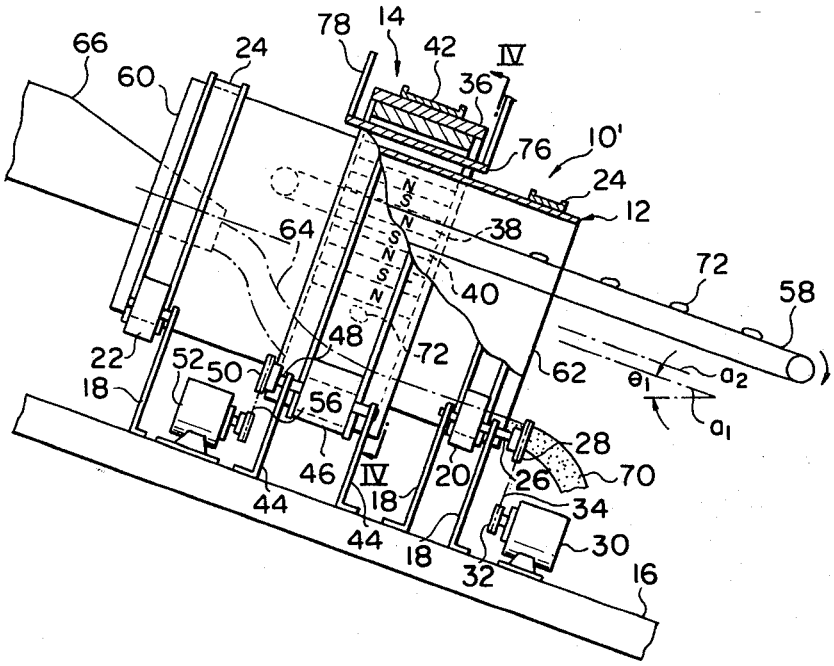
FIG. 3 is a front view, partly broken away, of a device for separating a mixture according to another embodiment of the invention.
Figure 4:
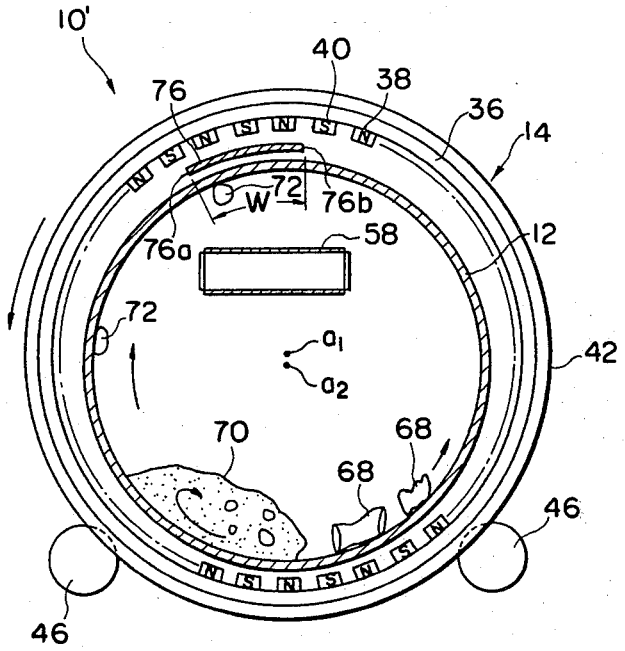
FIG. 4 is a transverse cross sectional view taken along the line IV—IV of FIG. 3.

In FIGS. 3 and 4, a separating device in the modified form of the present invention is shown generally at 10', with the components having the same functions as described with reference to FIGS. 1 and 2 being denoted by the indentical reference numerals with those in FIGS. 1 and 2.

In the separating device 10' in FIGS. 3 and 4, the magnetic means 14 is disposed with its axis $a_2$ being upwardly deviated by a small extent from the central axis $a_1$ of the drum, in order to provide a gap large enough to disposed a magnetic shield 76 between the drum 12 and the magnetic means 14 on the upper side of the drum 12, the magnetic shield 76 being a means for releasing the magnetic material 72 from the inner peripheral surface of the drum 12.

The magnetic shield 76 is formed of an arcuate magnetic panel, which is placed on the upper side of the drum 12 in a spaced relation to the outer peripheral surface of the drum 12 as well as to the magnetic means 14, and supported at the opposite ends thereof by a frame 78.

The magnetic panel 76 has a width W large enough to cover at least two adjacent magnets 38 and 40 of different magnetic poles among the plurality of permanent magnets arranged in a side-by-side relation to each other in the annular member 36, the width W being a size covering from one side edge **76*a* of the magnetic panel 76 to the other side edge 76*b*, as viewed in the circumferential direction of the drum 12. The magnetic panel 76 magnetically short-circuits the magnets 38 and 40 within a duration which the magnets 38 and 40 rotating integrally with the annular member 36 are passing the rotational zone opposing the magnetic panel 76. Consequently, the magnetic material 72 magnetically attracted to the inner peripheral surface of the drum 12 is released therefrom below the magnetic shield 76, to thereby drop on the belt conveyor 58**.

Figure 5:
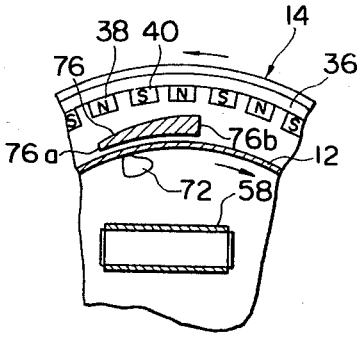
FIGS. 5(*a*) and (*b*) are fragmentary views of modified magnetic shields, respectively; and, FIGS. 6(*a*), (*b*) and (*c*), FIG. 7, and FIGS. 8(*a*) and (*b*) are perspective views of modified magnetic shields, according to the present invention, respectively.
Figure 5:
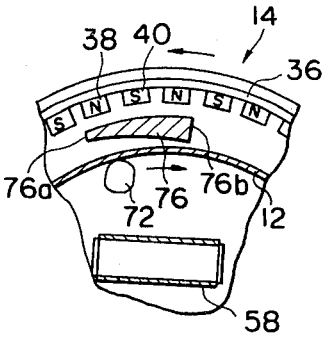
Figure 6A:
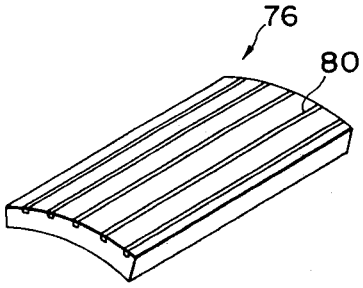
Figure 6B:
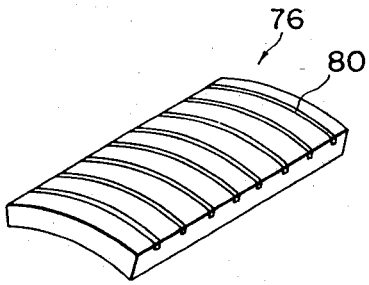
Figure 6C:
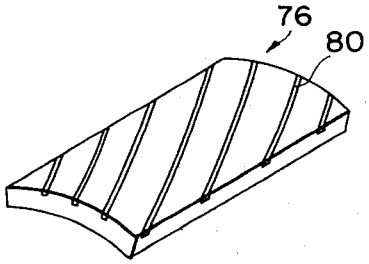

The thickness of the magnetic panel 76 may be increased from one side edge **76*a* toward the other side edge 76*b*, namely, in the direction of rotation of the drum 12, as clearly shown in FIGS. 5(*a*) and 5(b), so that the magnetic material 72 can be thoroughly released from the inner peripheral surface of the drum 12 at the same time, dropped on the belt conveyor 58, without giving any shock to the belt conveyor. In FIG. 5(*a*), the magnetic panel 76 is disposed in a manner that a spacing between the lower surface of the panel and the outer peripheral surface of the drum 12 is constant in the circumferential direction of the drum, and in FIG. 5(*b*), the magnetic panel 76 is so arranged that the spacing between the upper surface of the panel and the magnetic means 14 is constant in the circumferential direction of the drum 12**.

The magnetic panel 76 employed as the magnetic shield has a conductivity, in general. Thus, an eddy current is produced by the rotating magnetic field in the magnetic panel 76, and such eddy current would act as a strong resistance to rotation of the annular member 36. For this reason, it is recommended that a plurality of longitudinal, transverse or oblique grooves 80 be provided on the surface of the magnetic panel 76 in the manner shown in FIGS. **6(*a*), (*b*) and (*c*), respectively, so as to control generation of an eddy current on the magnetic panel 76** by the rotating magnetic field.

Figure 7:
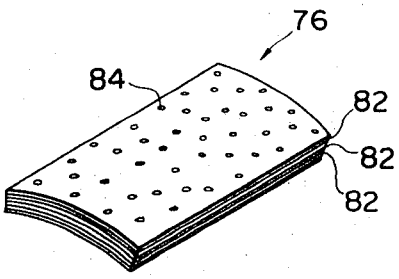

The magnetic shield 76 formed by superimposing a plurality of magnetic conductive thin plates 82, as seen in FIG. 7, is effective to control generation of an eddy current in the shield. Each thin plate 82 is preferably formed of a silicon-steel plate in which an eddy current is hardly generated. By providing a number of holes 84 in each silicon-steel plate 82, an increased effect of controlling generation of an eddy current results. If a number of wire nets are placed one upon another, a magnetic shield 76 greatly reduced in generation of an eddy current is obtained.

Figure 8A:
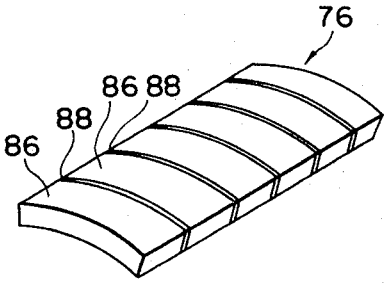
Figure 8B:
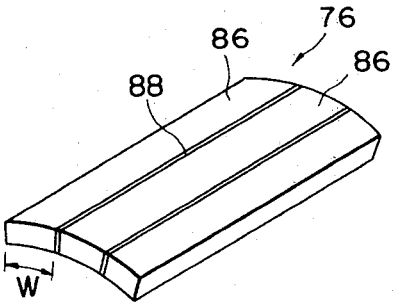

A magnetic shield 76 with reduced generation of an eddy current is also obtained by arranging and joining plates of a magnetic substance 86 and plates of an electrically insulating material 88, such as plastic, rubber or paper, alternately in a side-by-side relation in the longitudinal direction or in the transverse direction of the magnetic shield, as shown in FIGS. 8(*a*) and (*b*). Where the plates of a magnetic substance 86 and the plates of an electrically insulating material 88 are arranged alternately in a side-by-side relation in the transverse direction of the shield and joined together, as shown in FIG. 8(*b*), then respective plates of a magnetic substance 86 must have a width W sufficiently large to cover two adjacent magnets 38 and 40 of different magnetic poles.

In the separating device 10' of the second embodiment, so far as the spacing between the magnetic means 14 and the drum 12 is large enough to accommodate the magnetic shield 76 therein, the magnetic means 14 and the drum 12 may be disposed coaxially with each other, without a need of deflecting the rotational axis $a_2$ of the former from the rotational axis $a_2$ of the latter.

The separating device 10' of the second embodiment, and likewise the separating device 10 as shown in FIGS. 1 and 2, successfully achieves separation of the magnetic material 72, the nonmagnetic conductive material 68 and the nonmagnetic, material 70 from the mixture material 64, having no likelihood that separation of the nonmagnetic conductive material 68 from the mixture 64 is impeded by the magnetic material contained in the mixture in the conventional separation device.

The use of the magnetic shield 76 reduced in generation of an eddy current diminishes resistance to rotation of the magnetic means 14, thus appropriating the drive force of the magnetic means fully to rotation of the magnetic field. The magnetic field thus can be rotated at a high speed, and the electromagnetic action is increased, without causing a strong centrifugal force to act on the mixture material 64 in the drum 12, with the result of the increased separation efficiency.

In the former embodiments, the rotary annular member having a plurality of permanent magnets is shown as the magnetic means 14. As an alternative, an annular linear motor surrounding the drum 12 may be employed as the magnetic means.

It will be understood from the foregoing that, according to the present invention, the mixture material is separated into the magnetic material, the nonmagnetic conductive material, and the nonmagnetic nonconductive material by means on only a single device. The rotary magnetic field can be rotated at a high speed, without rotating at a high speed the drum into which the mixture has been thrown. Furthermore, the electromagnetic action of the rotating magnetic field is intensified, without causing a strong centrifugal force to act on the mixture material in the drum, with the assurance of separating the mixture material into the aforesaid materials with high efficiency.

What is claimed is:

1. A device for separating a mixture material comprising:

a drum disposed in a non-vertical posture and revolving in one direction about a longitudinal central axis thereof, said drum being formed of a nonmagnetic substance and supplied with a mixture material being treated;

an annular magnetic means surrounding said drum at a spacing from the outer peripheral surface thereof, and generating a magnetic field rotating in a reverse direction to the direction of rotation of said drum, so as to attract a magnetic material of said mixture material to the inner peripheral surface of said drum and exert on a nonmagnetic conductive material of said mixture material an electromagnetic force acting in the reverse direction to the direction of rotation of said drum;

a magnetic shield for releasing said magnetic material from the inner peripheral surface of said drum in a predetermined rotational region in said drum, said magnetic shield being disposed between said drum and said annular magnetic means on the upper side of said drum; and a means for receiving the magnetic material released from the inner peripheral surface of said drum.

2. A device for separating a mixture material as defined in claim 1, wherein said magnetic shield has a width large enough to cover adjacent magnets of different magnetic poles in said magnetic means.

3. A device for separating a mixture material as defined in claim 2, wherein said magnetic shield has a thickness increasing in the direction of rotation of said drum.

4. A device for separating a mixture material as defined in claim 2, wherein said magnetic shield consists of magnetic plate provided with a number of grooves on the surface thereof.

5. A device for separating a mixture material as defined in claim 2, wherein said magnetic shield consists of plates of a magnetic substance and plates of an electrically insulating material which are alternately placed one upon another.

6. A device for separating a mixture material as defined in claim 2, wherein said magnetic shield is a laminated plate formed by superimposing a plurality of magnetic conductors one upon another.

7. A device for separating a mixture material as defined in claim 6, wherein said magnetic conductor is a silicon-steel plate.

8. A device for separating a mixture material as defined in claim 7, whereing each magnetic conductor has a number of holes.

* * * * *